United States Patent [19]

Kendrick

[11] Patent Number: 4,489,985

[45] Date of Patent: Dec. 25, 1984

[54] CUTTER DRUM EXTENSION LATCHING MECHANISM

[75] Inventor: Frank B. Kendrick, Franklin, Pa.

[73] Assignee: Joy Manufacturing Company, Pittsburgh, Pa.

[21] Appl. No.: 394,348

[22] Filed: Jul. 1, 1982

[51] Int. Cl.[3] ..... E21C 27/24

[52] U.S. Cl. ..... 299/80; 175/267; 92/24; 92/27; 92/108

[58] Field of Search ..... 299/71, 78, 76, 80, 299/64; 92/15, 24, 25, 27, 28, 108

[56] References Cited

U.S. PATENT DOCUMENTS

| | | | |
|---|---|---|---|
| 2,771,060 | 11/1956 | Allbright | 92/24 |
| 3,109,635 | 11/1963 | Bergmann . | |
| 3,278,237 | 10/1966 | Karlovsky . | |
| 3,617,093 | 11/1971 | Daily | 299/80 |
| 3,695,725 | 10/1972 | Pendolino | 299/80 |
| 3,712,679 | 1/1979 | Amoroso | 299/76 |
| 3,844,618 | 10/1974 | Delli-Gatti, Jr. | 299/80 |
| 3,874,735 | 4/1975 | Delli-Gatti, Jr. | 299/68 |
| 4,076,316 | 2/1978 | LeBegve | 299/64 |

*Primary Examiner*—William F. Pate, III
*Assistant Examiner*—Mark J. DelSignore
*Attorney, Agent, or Firm*—Raymond W. Augustin

[57] ABSTRACT

A continuous mining machine cutting head structure is set forth. The mining machine is of a type having a support member and an elongated mining head member mounted on the forward end of the support member. The head member is powered for rotation about its longitudinal axis. The head member is of the type having axially extensible and retractable end portions. Included within the head member is a hydraulic piston cylinder arrangement for selectively extending and retracting these end portions. At least one latch element is included within each side of the head member and can be moved into locking engagement with the end portions when it is in an extended position thereby preventing retraction thereof. Also included is a mechanism operatively connected to the piston cylinder arrangement which is capable of moving the latch element out of engagement with the end portion thereby permitting retraction thereof.

6 Claims, 4 Drawing Figures

CUTTER DRUM EXTENSION LATCHING MECHANISM

BACKGROUND OF THE INVENTION

1. Field of the Invention

This invention relates to a continuous mining machine, and more particularly, to a continuous mining machine having a cutter drum member with extendable end portions. The present invention is directed to a means for locking the cutter drum extensions in their extended position.

2. Description of the Prior Art

In a continuous-mining apparatus of the type employed in this invention, a cutting head mechanism is used to dislodge material from a mine vein and is operable to provide mine passageway or room into which the apparatus advances and mining progresses. The cutting head mechanism is pivotably mounted on a mobile base to swing in a vertical plane between the mine roof and floor and includes a rotary drum cutting head assembly arranged on a horizontal transverse axis and having teeth or bits which tear away and dislodge the mineral. The apparatus also includes a conventional loading head for gathering the loose mineral on the mine floor and moving it rearwardly and inwardly towards the forward receiving portions of the conveying means of the apparatus. The rotary drum cutting assembly has end portions thereof which can be selectively extended or retracted, to respectively, dislodge mineral from the ribs and corners of the mine passageway and reduce the effective length of the cutting head assembly to provide clearance at the sides of the assembly.

A good example of a mining machine drum cutter extension means in which the present invention can be utilized is shown in U.S. Pat. No. 3,617,093 issued to E. A. Bailey on Nov. 2, 1971. A second patent, U.S. Pat. No. 3.695,725 issued to E. F. Pendalino on Oct. 3, 1972 discloses a similar structure. These two patents are assigned to the assignee of the present application. The teachings of these two U.S. patents are incorporated in this application by reference.

U.S. Pat. No. 3,516,712 discloses a mining machine with an extendable head having a spring return mechanism. The means for extending the extensible head is a hydraulic cylinder.

U.S. Pat. Nos. 3,844,618 and 3,874,735 disclose mining machines having rotary motor extended cutting heads. In these patents a rotary motor drives a screw system which extends the cutting head.

It has been found that after the cutting head has been extended forces developed during mining tend to move the cutting head towards its retracted position by driving hydraulic fluid back across the valve shown in FIG. 5 of U.S. Pat. No. 3,617,093 or backing off the screw threads disclosed in U.S. Pat. Nos. 3,844,618 and 3,874,735.

In addition, dust and grid from the mining operation gets into the hydraulic system degrading the operation of hydraulic pumps, control valves, seals and check valves and thereby permitting fluid leakage around various components in the hydraulic system. Degradation of the seals causes leakage of fluid out of the system. The net effect of this degradation is to permit nonselective retraction of the end extension portions during operation of the mining machine.

Consequently, the present invention relates to an automatic means for locking the cutter head extensions in these extended positions utilizing one or more mechanical latchs. As will be described below the locking means of the present invention maintains the cutter drum in its extended position and unlatches the same for movement towards its retracted position without the addition of any control features on the mining machine.

SUMMARY OF THE INVENTION

It is an object of this invention to provide a method for locking the end portions of a cutter drum member which is rotatably mounted at the forward end portion of a boom member on a continuous mining machine in their extended position.

It is a further object of this invention to provide a mechanical locking means capable of engaging the cutter drum extensions of the cutting head of a continuous miner and preventing retraction thereof.

It is still an additional object of this invention to provide a latching means which is capable of locking the drum extension in its extended position and is automatically unlatched during selective retraction of the cutter drum extension.

It is yet an additional object of this invention to provide a spring loaded mechanical latch to lock the drum extension in its extended position and which latch can be automatically unlatched by means of the fluid cylinder which provides for the extension and retraction of the drum extension.

In accordance with the present invention, there is provided an improved continuous mining machine of the type that includes an elongated body portion mounted on devices for propelling the body portion. A support member is pivotally secured to the body portion and extends forward therefrom. An elongated mining head member is mounted on the forward end of the support member for powered rotation about a longitudinal axis of the head member. The head member has axially extensible and retractable end portions. The head member includes hydraulic pistons and controls therefor for the selective and extension retraction of the end portions. Included within the hydraulic system is a latch element supported by the head member and including means for moving the latch member into locking engagement with the end portion when the end portion is in its fully extended position. The latch element prevents the nonselective retraction of the end portion from its extended position. Also provided are means operatively connected to the means for selective extension and retraction of the end portions for moving the latch element out of engagement with said end portion thereby allowing the selective retraction thereof.

These and other objects of this invention will be more completely disclosed and described in the following specification, the accompanying drawings and the appended claims.

DESCRIPTION OF THE PREFERRED EMBODIMENTS

Figure 1:
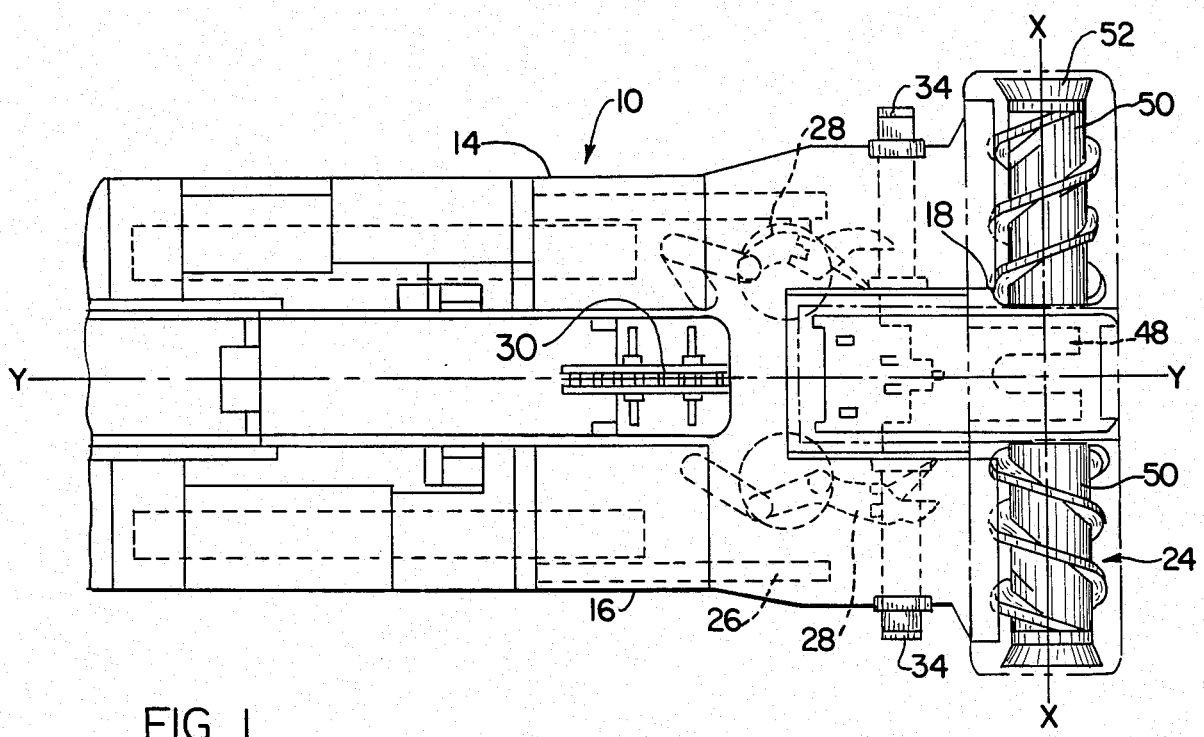
FIG. 1 is a partial plan view of a mining machine emboding the principals of the present invention.

A continuous mining machine generally designated as 10, which embodies the principles of this invention, may assume various forms but, for illustrative purposes, herein comprises a crawler base 14 carrying a frame 16 on which a forwardly extending mining boom or support member 18 is pivotally mounted at the forward end of the frame 16 to swing up and down between a mine roof and a mine floor. An elongated mining head member 24 extends transversely to the support member 18 and is rotatably secured thereto at the forward end thereof. The mining head member or cutter head 24 is mounted for powered rotation about a longitudinal axis X—X of the head member. Pivotally mounted at the forward end of the frame 16 and extending forwardly therefrom beneath the support member 18 is a conventional loading head 26 having oscillatory gathering arms 28 for engaging mine mineral and moving such mineral rearwardly and inwardly towards well known conveying means 30 of the mining machine 10. Conventional hydraulic jacks (not shown) serve to swing the support member 18 in a vertical plane about the pivot axis thereof and to tilt the loading head 26 about the horizontal axis.

The elongated mining head member 24 is driven from a pair of motors 34. As shown motors 34 are in spaced axial alignment and extend generally parallel to assembly 24. Motors 34 are suitably carried by a support member 18 at opposite side portions thereof.

The drive from motors 34 rotatably drives a cutting head assembly head shaft 36. Head shaft 36 extends parallel to the longitudinal axis of the head member 24 and is captively and rotatably supported by tubular gear casing extensions 38 which also extend parallel to the longitudinal axis of the head member. The gear drive system for the mining head member may be that shown in either U.S. Pat. No. 3,617,093 or 3,695,725.

Figure 2:
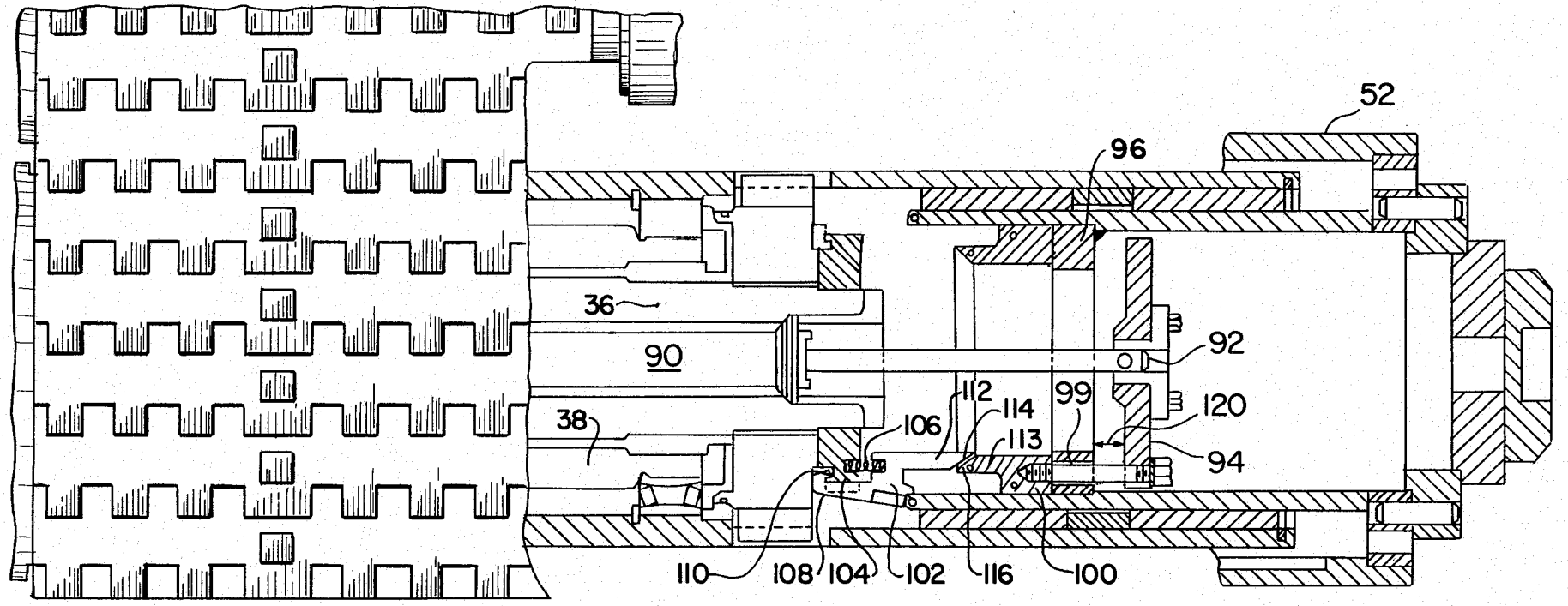
FIG. 2 is an enlarged view showing the main gear casing in a portion of the cutter head assembly of the mining machine shown in FIG. 1 with the latch mechanism of the present invention in its locked position.
Figure 3:
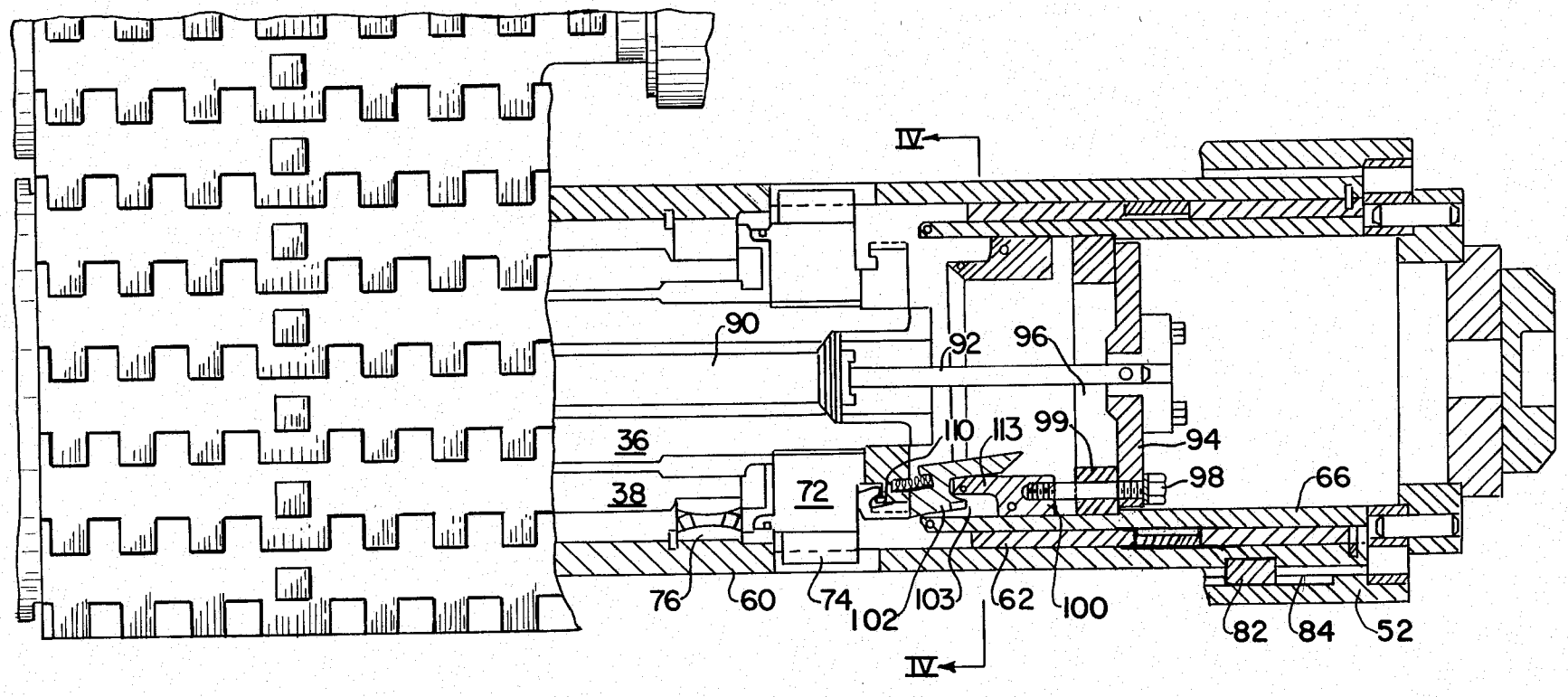
FIG. 3 is an enlarged view showing the half of the cutter head assembly as is shown in FIG. 2 with the latch mechanism of the present invention shown in the unlatched position with the extension retractive.
Figure 4:
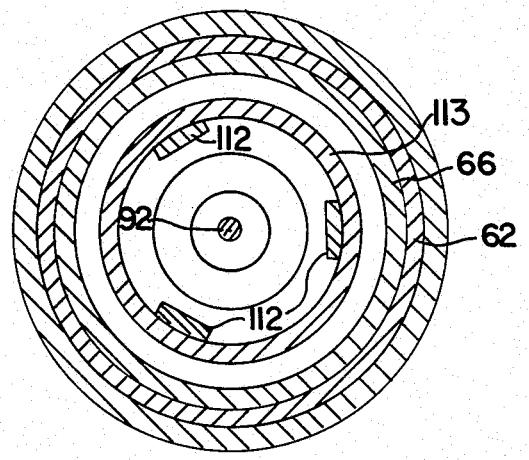
FIG. 4 is a sectional view of the about the lines 4—4 of FIG. 3.

It is to be noted that in as much as the elongated mining head member 24 described herein as symmetrical with respect to the center line Y—Y of machine 10, only one half of the assembly 24 then and the supporting structure therefor is shown in detail in FIGS. 2 and 3 with the understanding that the unshown half is substantially identical thereto. Additionally, inasmuch as the description hereinabove and hereinafter refers to elements of assembly 24 and the supporting structure therefore on both sides of the center line Y—Y while only one of such elements is shown it is to be understood that the unshown element is identical in construction and location to the illustrated element.

As hereinafter described head shaft 36 rotatably drives: an endless circulating belt type continuous hinge cutter chain 48, hollow cylindrical rotary drum cutting heads 50 and hollow cylindrical rotary drum cutting head extension portions 52 which include cylindrical portion 66 which are partially slideably, received within the ends of respective heads 50. The portions 52 are selectively hydraulically extendable and retractable therefrom. An operator can selectively extend or retract the extension portions via a hydraulic control system.

As can be seen in FIGS. 2 and 3, the head shaft 36 drives the outer peripheral member 60 of the cutting head 24 via drive ring 72 which engage a plurality of circumferentially spaced keys 74. The outer peripheral member 60 is supported on casing extension 38 by bearing 76 and other internal bearings (not shown).

In the preferred embodiment the hollow cylindrical rotary drum extendable end portions 52 have an inner diameter thereof larger than the outer diameter of cutting head 60 and are rotatably driven by the cutting head 60. As shown in FIGS. 2 and 3, a plurality of circumferentially spaced keys 82 have the inner ends thereof fixedly secured to the outer peripheral portion of the cutter head 60. Consequently, the head 60 drives the end portions 52 by means of keys 82 drivingly engaging respective ones of a plurality of cooperating key ways in member 52. The keys 82 and the key ways 84 are circumferentially spaced about the inner periphery of the cylinder 52. The above described key and key way driving arrangement additionally allows for the reciprocal axial movement of cutting head end portions 52 with respect to cutting heads 60 by the axially sliding relationship which exists between keys and key ways 82 and 84, respectively.

In the preferred embodiment the extension of the end portions 52 is accomplished by a hydraulic cylinder 90 in conjunction with its piston rod 92. The rod 92 is fixedly connected to plate 94 which is slideably mounted within the inner diameter of cylinder 66 of end portion 52. In the preferred embodiment an annular drive ring 96 is fixedly attached to the inner diamter of cylinder 66 for movement therewith. Drive ring 96 has a plurality of holes 99 within its outer annular surface to accommodate a plurality of bolts 98 which have one end threadably engaged with the piston 94 for movement therewith and the other end fixedly attached by threads to latch release member 100. The holes 99 located on drive ring 96 have a diameter slightly larger than the diameter of bolt 98 to permit the bolts 98 to slide therethrough. Consequently the piston 94 and the latch release member 100 move as a unit in the direction of longitudinal axis X—X.

As can be best seen in FIG. 2 at least one latch member 102 is pivotally mounted on a mounting ring 104 which is fixedly attached to head shaft 36 for rotation therewith. The latch member 102 is springed biased into engagement with the axially inner annular end of cylinder 66 by spring 106 when the end 52 in its extended position. The spring 106 causes latch 102 to rotate or pivot about its hooked or pivoted end 108. The hooked end 108 is captured within a groove 110 on the axially inner end. This configuration prevents radial movement of hooked end 108 of latch 102 while allowing the pivotal movement. The hooked portion 108 is prevented from axial movement with respect to the groove 110 by drive ring 72.

In the preferred embodiment three latches 102 each shaped as a part or a section of a cylinder are circumferentially spaced around the cylinder 66 and ring 104. To distribute the loads evenly the three latches are spaced at 120° angles with respect to one another about shaft 36. The circumferential width of each latch 102 can be determined by the utilization of basic engineering principals and the loads applied to extension 52.

The latch member 102 has an end portion 112 with a camming surface 114 thereon. The camming surface 114 is located adjacent a similar cam surface 116 on an arm 113 of the latch release member 100. In the preferred embodiment the latch release member 100 is a cylinder.

It should be noted that since ring member 104 is mounted on head shaft 36 for rotation therewith that the relative circumferential positions of latch member 102 and latch release member 100 remain constant with respect to the position of head shaft 36. Consequently the camming surfaces 114 and 116 are always capable of engagement when the end portion 52 is in its extended position.

The preferred operation of the locking mechanism of the present invention can now be described. As can best be seen in FIG. 3 when the end portions 52 are in their retracted position the arm 113 of latch release member 100 is located radially outwardly of arm 112 of latch member 102. In this position the latching surface 103 is disengaged from the axially inner end of cylinder 66. When extension of the end portion 52 is desired cylinder 90 and rod 92 are actuated to move the piston 94 and consequently the cylindrical latch release 100 axially outwardly until the outer axial surface of latch release 100 engages the ring 96. The ring 96 is fixed to cylinder 66. The cylinder 66 is coupled to extension end portions 52 at least in the axial direction, so that movement of cylinder 66 along the inner circumference of fixed cylinder 62 also moves the extension portion 52 in the axial direction. At this point further movement of the piston 94 moves the ring portion 96 axially outwardly until the end portion 52 is its fully extended position as shown in FIG. 2. The relative lengths of arms 112 and 113 are predetermined such that when the end portion 52 is in its fully extended position the arms 112 and 113 disengage and the spring 106 biases the latch element 102 radially outwardly so that latching surface 103 engages the axially inward annular surface of cylinder 66 thereby preventing axial inward movement of the end portion 52 towards its retracted position. As can be seen this locking action is independent of any locking action provided within the hydraulic system such as check valves or the control valve.

As can be best seen in FIG. 2, when the operator wishes to retract the end portions 52 he again actuates cylinder 90 and rod 92 but this time in the axially inward direction which causes piston 94 and the latch release element 100 to also move axially inwardly. Upon movement of the latch release member in the axial inward direction cam surface 116 on element 100 engages cam surface 114 on the latching element 102 thereby forcing the latching surface 103 to disengage from the cylinder 66. Again the length of arms 113 and 112 and of gap 120 are such that the latch 102 releases prior to the engagement of piston 94 with ring 96. Since ring 96 is fixed to cylinder 66 the drum extension portion cannot retract until the engagement between piston 94 and ring 96 occurs. After latch 102 has released the end portions 52 may be moved by the action cylinder 90 and cylinder rod 92 until it reaches its fully retracted position. The shape of cam surfaces 114 and 116 may vary as long as the required radially inward force to unlatch the mechanism is generated.

It can be seen that many other embodiments of the present invention could be utilized to lock the drum extensions 52 in their extended positions. As for example, either a greater or lesser number of latches 102 and the number taught above could be utilized. Also the latch system as taught could be used on a continuous miner having a nonhydraulic means for extending the end portions. For example, a continuous miner having a screw means for extending the end portions could utilize the present invention by installing the latching system to engage an inner cylindrical member such as inner sleeve member 31 of U.S. Pat. No. 3,844,618.

I claim:

1. An improved mining machine cutting structure having a unitary support member, an elongated cutting head assembly mounted at the forward end of said support member for powered rotation about a longitudinal axis of said head assembly, said cutting head assembly having a centrally located main cutting head portion and drum extension portions located at the ends of said cutting head axially outward of said main cutting head portion, said drum extension portions capable of moving in an axial direction to and from an extended position with respect to said main cutting head portion, and a hydraulic cylinder including a piston rod connected to said end portions for the selective extension and retraction of said end portions, wherein the improvement comprises:

at least one latch element associated with each extension portion and said main cutting head, a spring means for moving said latch element into locking engagement between said head said drum extension when said extension is in extended position to prevent non-selective retraction thereof, and a camming element associated with said piston rod for movement therewith for moving said latch element out of locking engagement between said head and said drum extension portion during a portion of the stroke of said piston rod prior to the selective retraction of said drum extension portion.

2. The improved mining machine cutting structure as set forth in claim 1 wherein each of said latch elements and said camming element are provided with complimentary camming surfaces so that when said camming element associated with said piston rod is moved axially inwardly with respect to said longitudinal axia said cam surface on said camming element engages said cam surface on said latch element providing a force capable of moving said latch element out of engagement with said drum extension.

3. A mining machine cutting structure as set forth in claim 2 wherein said camming element connected to said piston rod moves said latching element out of locking engagement with said head and said drum extension is operatively connected to said piston rod for movement therewith and engages said latch element prior to that portion of the stroke of said piston rod which provides for the selective retraction of said drum extension portions.

4. A drum extension latching mechanism for a mining machine cutting structure having a unitary support member, an elongated cutting head assembly mounted at the forward end of the support member for powered rotation about a longitudinal axis of said head assembly, said head assembly having a longitudinally extending main cutting head and axially extensible and retractable drum extensions at the axially outer ends of said main cutting head, said cutting head assembly having a hydraulic cylinder and piston rod connected to said reciprocable drum extensions for the selective extension and retraction of said reciprocable drum during only a part of the stroke of said piston rod, said drum extension portion having an internal cylindrical portion, said latching mechanism comprising:

at least one latch element, said latch element supported by said main cutting head and movable with respect thereto;

said latch element biased into locking engagement with said internal cylindrical portion upon movement of said drum extension to its extended position to prevent nonselective retraction of said reciprocal drum extension portion; and a cam element associated with said piston rod for movement therewith for moving said latching element against said biasing out of locking engagement with said drum extension prior to said part of said stroke of said piston which permits said selected retraction of said drum extension portion.

5. The improved mining machine cutting structure as set forth in claim 4 wherein said latch element and said camming element are provided with complimentary camming surfaces so that when said camming element is moving axially inwardly with respect to said longitudinal axis said cam surface thereon engages said cam surface on said latch to provide a force capable of moving said latch element against said biasing means out of engagement with said internal cylindrical portion.

6. An improved mining machine cutting structure of the type having a support member, and elongated mining head member mounted on the forward end of said support member for powered rotation about a longitudinal axis of said head member and having axially extendable and retractable end portions, said head member including a hydraulic cylinder and piston rod for the selective extension and retraction of said end portions, wherein the improvement comprises:

at least one latch element mounted on one of said head or said extendable end portions;

means for moving said latch element into locking engagement between said head and said extendable end portions when said end portion is in its selectively extended position to thereby prevent nonselective retraction thereof; and means associated with said piston rod for movement therewith for moving said latch element out of locking engagement between said head and said end portion during a part of the stroke of the piston rod prior to the initiation of said selective retraction of said end portions.

* * * * *